US005827047A

United States Patent [19]

Gonsor et al.

[11] Patent Number: 5,827,047

[45] Date of Patent: Oct. 27, 1998

[54] TURBINE BLADE DAMPER AND SEAL

[75] Inventors: Michael Gonsor, Hebron; Sanford E. Kelley, III, Vernon; David P. Houston, Glastonbury, all of Conn.

[73] Assignee: United Technologies Corporation, Hartford, Conn.

[21] Appl. No.: 671,462

[22] Filed: Jun. 27, 1996

[51] Int. Cl.[6] ..... F01D 5/10

[52] U.S. Cl. ..... 416/193 A; 416/248; 416/500

[58] Field of Search ..... 416/193 A, 190, 416/219 R, 220 R, 221, 248, 500

[56] References Cited

U.S. PATENT DOCUMENTS

| | | | |
|---|---|---|---|
| 3,112,915 | 12/1963 | Morris . | |
| 3,266,770 | 8/1966 | Harlow | 416/193 A |
| 3,610,778 | 10/1971 | Suter . | |
| 3,751,183 | 8/1973 | Nichols et al. . | |
| 3,887,298 | 6/1975 | Hess et al. . | |
| 4,101,245 | 7/1978 | Hess et al. . | |
| 4,182,598 | 1/1980 | Nelson . | |
| 4,505,642 | 3/1985 | Hill . | |
| 4,516,910 | 5/1985 | Bouiller et al. . | |
| 4,743,164 | 5/1988 | Kalogeros | 416/193 A |
| 4,872,810 | 10/1989 | Brown et al. . | |
| 4,872,812 | 10/1989 | Hendley et al. . | |
| 5,156,528 | 10/1992 | Bobo . | |
| 5,228,835 | 7/1993 | Chlus . | |
| 5,302,085 | 4/1994 | Dietz et al. . | |
| 5,313,786 | 5/1994 | Chlus et al. . | |
| 5,415,526 | 5/1995 | Mercadante et al. . | |
| 5,460,489 | 10/1995 | Benjamin et al. . | |
| 5,513,955 | 5/1996 | Barcza . | |

*Primary Examiner*—Christopher Verdier

[57] ABSTRACT

A damper for a turbine blade in a gas turbine engine includes a main body and may include at least one extended end which is adapted to clear radially inner surfaces of two adjacent blade platforms, to enhance the damping profile of the damper and radial support for a seal. An associated seal for the turbine blade includes supported and sealing portions and may further include a locator that interfaces with a catch structure on the blade to maintain the seal in the proper axial position with respect to the radially inner surfaces of the adjacent platforms. The seal may further include a projection adapted to provide interference with the blade in the event that the damper and seal are installed improperly with respect to each other to prevent such improper assembly.

53 Claims, 3 Drawing Sheets

FIG.2
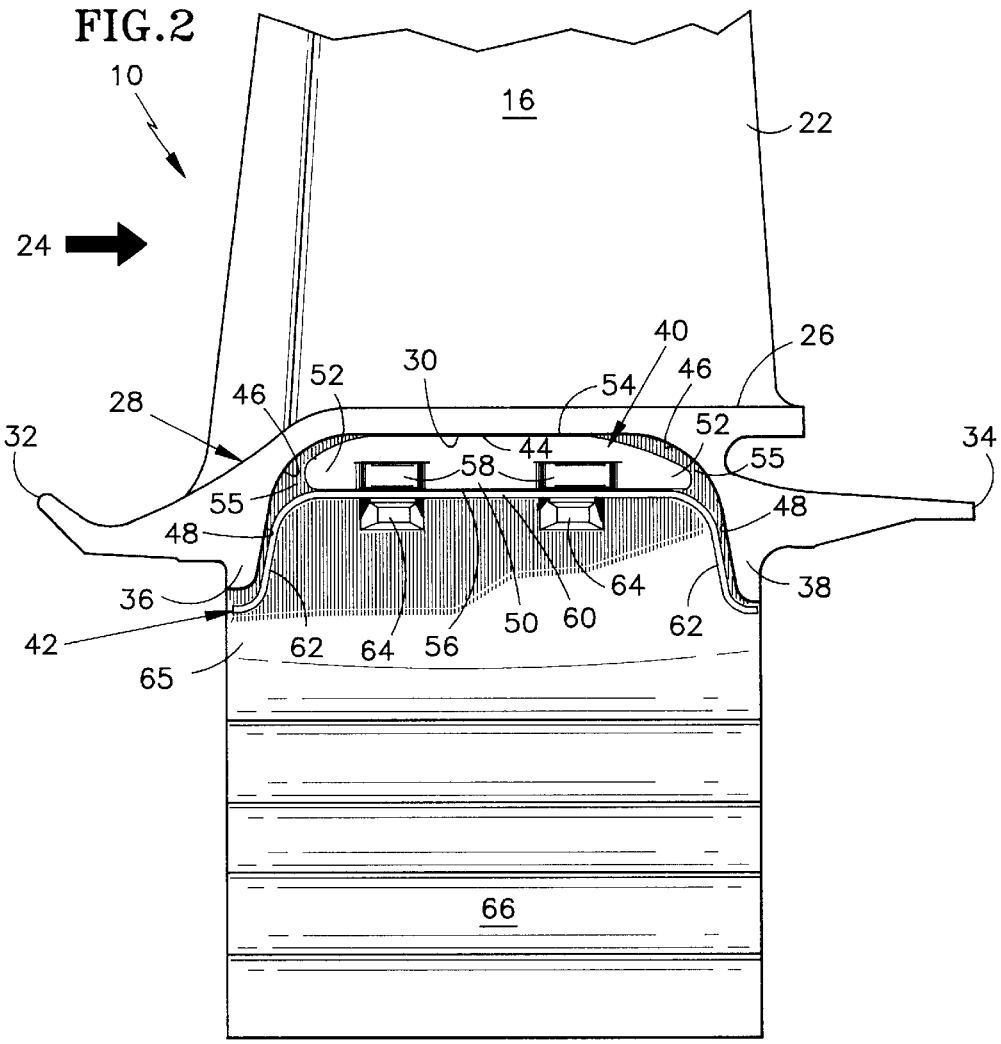
FIG.3
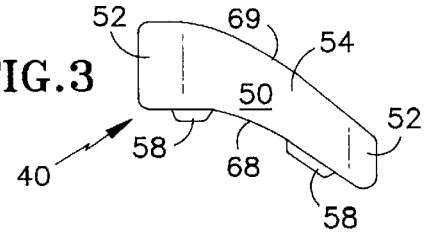
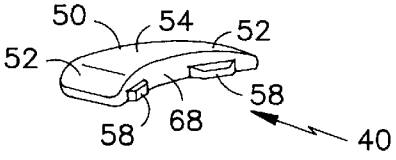
FIG.4
FIG.5
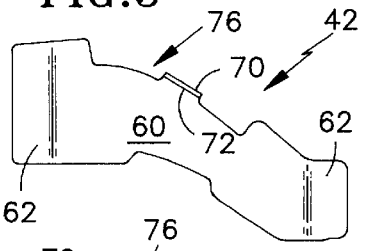
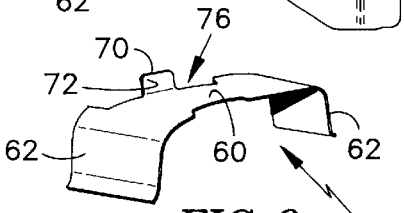
FIG.6

TURBINE BLADE DAMPER AND SEAL

DESCRIPTION

1. Technical Field

The invention relates to gas turbine engines and more particularly to damper and seal configurations for turbine rotors.

2. Background Art

A typical gas turbine engine has an annular axially extending flow path for conducting working fluid sequentially through a compressor section, a combustion section, and a turbine section. The compressor section includes a plurality of rotating blades which add energy to the working fluid. The working fluid exits the compressor section and enters the combustion section. Fuel is mixed with the compressed working fluid and the mixture is ignited to add more energy to the working fluid. The resulting products of combustion are then expanded through the turbine section. The turbine section includes another plurality of rotating blades which extract energy from the expanding fluid. A portion of this extracted energy is transferred back to the compressor section via a rotor shaft interconnecting the compressor section and turbine section. The remainder of the energy extracted may be used for other functions.

Each of the plurality of rotating blades in the turbine section has a platform. A blade root extends from one surface of the platform, and a blade airfoil projects from an opposing surface. The airfoil, which may be shrouded or unshrouded, extracts the kinetic energy from the expanding working fluid. The plurality of rotor blades are distributed among one or more rotating turbine rotors. A turbine rotor has a disk having a centerline and a series of slots in its outer perimeter. Each slot receives a blade root, thereby retaining the blade to the disk. So installed, the blade extends radially from the disk, with the root radially inward and the airfoil radially outward. Adjacent blade platforms are separated by an axially extending gap, which keeps the blades platforms from contacting and damaging each other.

As the airfoils extract energy from the expanding working fluid, the working fluid exerts a loading force on the airfoils. Variations in the loading force cause the blades to deflect and vibrate. This vibration has a broad spectrum of frequency components, with greatest amplitude at the natural resonant frequency of the blades. When the airfoils are unshrouded, the vibration is primarily tangential to the direction of rotation, i.e. the circumferential direction. There, is also a secondary vibration component in the direction of fluid flow, i.e. the axial direction. If undamped, the deflection of the vibrating blades can reach extreme limits, potentially causing the airfoil to break.

The susceptibility of the turbine to blade vibration failure depends in part on effective damping. A damper is generally employed to reduce such vibration. The damper is a rigid element which is positioned to span the gap between blades and contact the radially inner surfaces of adjacent blade platforms. The damper reduces blade to blade vibration which consequently reduces individual blade vibration. The shape, weight, and stiffness of the damper is selected to best provide the desired vibration damping friction force. For maximum effectiveness, the damper is generally elongated in the axial direction.

The friction force provided by the damper is split between the adjacent blades. Generally, an even split is sought, i.e. fifty percent to one blade and fifty percent to the other blade. However, the shape and contour of the radially inner surfaces of the blade platforms, in conjunction with the other damper selection criteria mentioned above, may not allow a damper which provides the desired damping profile. In such instances, damping effectiveness may be reduced, resulting in lower blade reliability. Therefore, a damper which offers more flexibility in vibration damping to produce the desired damping profile is sought.

Aside from vibration failure, there further exists the possibility of turbine failure due to the potential leakage of the working fluid into the gap between adjacent blade platforms. Once in the gap, the working fluid can then leak into the area beneath the radially inner surface of the platform. Since the temperature of the working fluid in the turbine is generally higher than that which components beneath the platform can safely withstand, leakage raises the temperature of these components and generally results in lower turbine reliability. Furthermore, since the working fluid may contain contaminants, leakage can transport contaminants beneath the platform further reducing the reliability of the turbine. In addition, the leaking working fluid circumvents the airfoils, thus reducing the amount of energy delivered to the airfoils and reducing the efficiency of the turbine.

A seal is generally employed to reduce leakage. The seal is a flexible element, typically made of thin sheet metal, which is positioned across the gap, beneath and in proximity to the radially inner surfaces of adjacent blade platforms. The seal typically has a portion which generally conforms with that of the surface with which it is to seal.

The seal typically requires radial support from the damper. One example of such a damper and seal configuration is disclosed in U.S. Pat. No. 5,460,489. However, if the damper does not provide sufficient radial support, e.g. along a sufficient portion of the axial length of the seal, then the seal may be susceptible to distortion upon turbine rotation due to radial centrifugal forces. The constraints on the design of the damper, described above, frequently limit the radial support that the damper can provide to the seal. Should the seal experience such distortion, its proximal relation to the surfaces with which it seals may be undesirably altered, and consequently, sealing effectiveness may be reduced. It is therefore and object to provide a damper and seal configuration which offers more design flexibility in order to obtain greater radial support for the seal.

Generally, the seal is only loosely captured in the axial direction by the structure beneath the platform. However, to preserve optimum proximal relation of the seal to the surfaces with which it seals, the seal must be maintained in the proper axial position relative to the radial inner surface of the adjacent blade platforms. If the seal is not maintained in the proper axial position, the effectiveness of the seal in reducing leakage may be decreased. A seal which can be maintained in proper axial position is therefore sought.

Finally, in order to provide effective damping and sealing, the damper and seal must be installed in proper relative position with respect to each other. However, in prior art arrangements, the damper and seal may fit in the turbine assembly even though installed improperly, and consequently, in current turbine configurations there is a potential for misassembly. This potential is increased by the fact that some configurations have the damper disposed between the platform and the seal, while others have the seal disposed between the platform and the damper. As a result, the damper and seal are occasionally installed improperly, thereby reducing the effectiveness of both the damper and the seal. It is therefore an object to provide a damper and seal configuration which prevents the installation of the damper and seal in improper orientation with respect to each other.

DISCLOSURE OF THE INVENTION

According to a first aspect of the present invention, a damper for a turbine rotor includes a main body and further includes at least one extended end joined to the main body, wherein the main body contacts and provides a friction force on radially inner surfaces of two adjacent blade platforms in the presence of a centrifugal force, and where there is a clearance between the extended and the radially inner surfaces of the platforms to obviate any interference therebetween. A damper having at least one extended end provides greater design flexibility for producing the desired damping profile. Because of the clearance between the extended end and the radially inner surface of the platform, the extended end can extend over areas of the inner surface that the main body should not contact, due to the risk of interfering with the desired contact area between the main body and the inner surface. Since the weight of the damper includes the weight of the extended end, the addition of the extended end allows greater flexibility in distributing the weight of the damper. Consequently, there is greater flexibility for producing the desired damping profile, including but not limited to, a more even distribution of the damper friction force between the two adjacent blades, thereby improving damping effectiveness. The one or more extended ends are preferably a pair of tapered axial extensions.

In further accordance with the first aspect of the present invention, a damper and seal configuration for a turbine rotor includes a damper having a main body and at least one extended end, and further includes a seal having a supported portion and at least one sealing portion adapted to provide a seal against adjacent blade platform radially inner surfaces, where the main body and at least one extended end of the damper combine to provide a radial support surface for the seal. A damper and seal configuration having a damper with at least one extended end provides greater damper and seal design flexibility and allows for additional (enhanced) radial support for the seal. This additional radial support reduces the undesired distortion in the seal under centrifugal forces, and consequently results in greater sealing effectiveness than that which can be achieved without at least one extended end.

According to a second aspect of the present invention, a damper and seal configuration for a turbine rotor includes a damper and further includes a seal having a projection adapted to provide interference with the blade in the event that the damper and seal are installed in an improper orientation with respect to each other to prevent such improper assembly. The projection (locator) is preferably a tab shaped and joined to the support portion of the seal.

According to a third aspect of the present invention, a seal for a turbine rotor includes a locator that interfaces with a catch structure on the blade to positively position and maintain the seal in the proper axial position with respect to the radially inner surface of the blade platform, thereby maintaining sealing effectiveness. The locator is preferably a notch or scallop and the catch on the blade is preferably a pair of stand-offs.

BRIEF DESCRIPTION OF THE DRAWINGS

FIG. 2 is a side view of the rotor blade and damper and seal configuration of FIG. 1;

FIG. 3 is a top view of the damper of FIG. 1;

FIG. 4 is a perspective view of a concave side of the damper of FIG. 1;

FIG. 5 is a top view of the seal of FIG. 1;

FIG. 6 is a perspective view of the side of the seal of FIG. 1;

BEST MODE EMBODIMENT FOR CARRYING OUT THE INVENTION

Some of the subject matter herein may be disclosed and/or claimed in the following copending applications: "Turbine Blade Platform Seal", U.S. Ser. No. 08/772,962; "Turbine Blade Damper and Seal", U.S. Ser. No. 08/773,017; and "Turbine Engine Rotor Blade Platform Sealing and Vibration Damping Device", U.S. Ser. No. 08/772,838.

Figure 1:
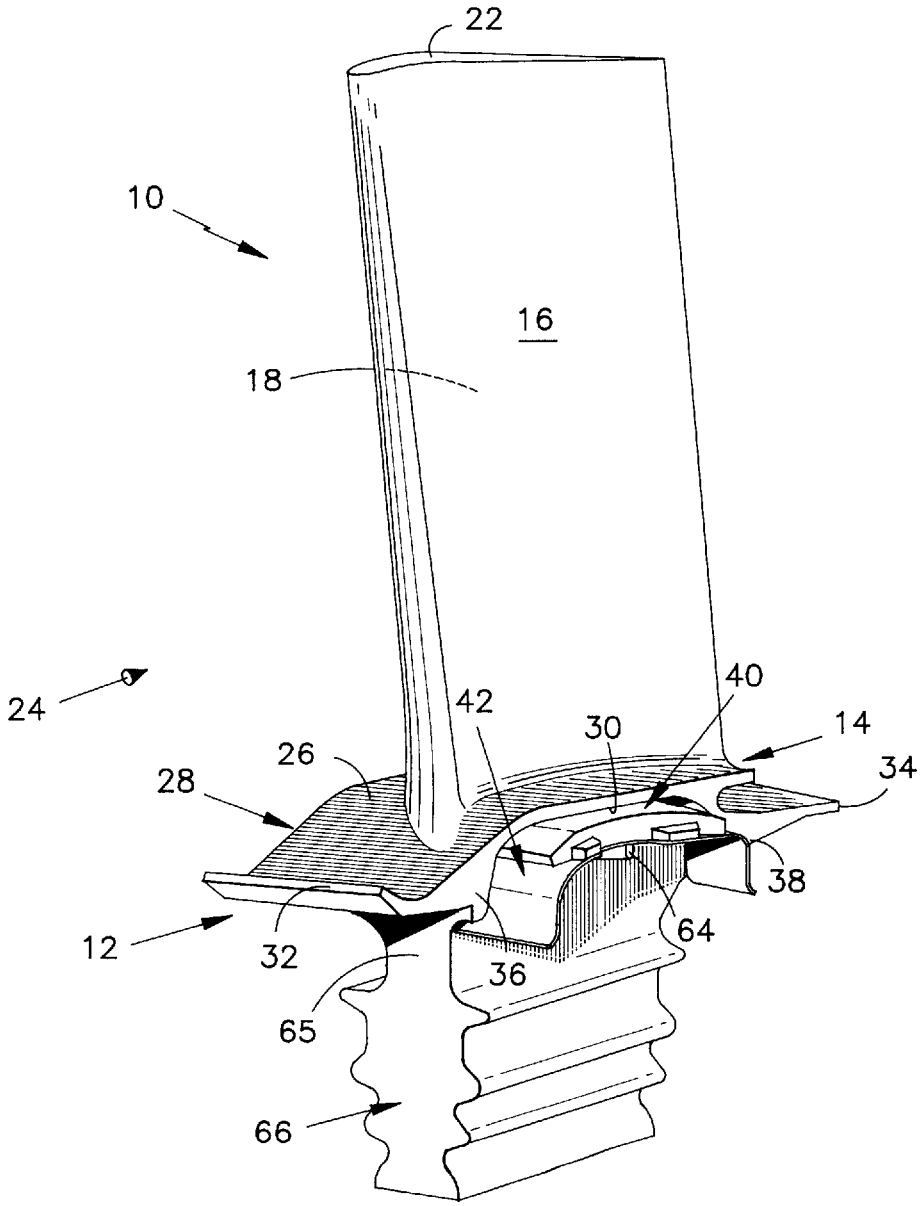
FIG. 1 is a perspective view of a turbine rotor blade with the damper and seal configuration of the present invention may be used.

The damper and seal configuration of the present invention is disclosed with respect to a best mode embodiment for use with a second stage high pressure turbine rotor blade of the type illustrated in FIG. 1. As should be understood by those skilled in the art, the drawings are meant to be illustrative only are not intended to portray exact structural dimensions.

Referring to FIG. 1, a turbine rotor blade 10 has a upstream side 12, a downstream side 14, a concave (pressure) side 16, and a convex (suction) side 18. The rotor blade 10 has an airfoil 22, which receives kinetic energy from a gas flow 24. The airfoil 22, which may be shrouded or unshrouded, is disposed on a radially outer surface 26 of a platform 28. The platform 28 further comprises a radially inner surface 30, a leading edge 32 and a trailing edge 34. A pair of platform supports 36, 38 provide structural support for the platform 28 to reduce distortion in the platform. In the best mode embodiment, the rotor blade 10 is fabricated as a single integral unit by casting, however, any other suitable means known to those skilled in the art may also be used.

The rotor blade 10 further comprises a neck 65 of reduced thickness, and a root 66. The neck 65 is the transition between the platform 28 and the root 66. The root 66 is inserted into a turbine rotor central disk (not shown) to attach the rotor blade to the disk. In the best mode embodiment, the root 66 has a fir tree design, however, any suitable means for attaching the blade to the disk may be used. The neck 65 has a pair of protrusions 64 (only one shown) which are described and shown in further detail hereinbelow.

While not shown, the rotor blade 10 is one of a plurality of such blades attached to a rotor disk having a centerline (longitudinal axis) (not shown). The blade 10 extends radially from the disk, with the root 66 radially inward and the airfoil 22 radially outward. Adjacent blade platforms are separated by an axially extending gap, which keeps the blades platforms from contacting and damaging each other. The width of this gap should be large enough to accommodate the tolerances in the physical dimensions of the platforms including thermal expansion. In the best mode embodiment, the width of the gap is on the order of about 0.04 inches, however any suitable gap width may be used.

Located beneath the radially inner surface 30 of the platform 28 is a damper 40 and seal 42 configuration according to a best mode embodiment thereof. The damper 40 is a rigid element adapted to reduce blade-to-blade vibration which consequently reduces individual blade vibration. The damper 40 also provides support for the seal 42. The damper 40 is positioned to span the gap between the platform 28 and the adjacent blade platform (not shown) and to contact the radially inner surfaces of the platforms. The shape, weight, and stiffness of the damper is selected to best provide the desired friction force to the platforms for such damping. For maximum effectiveness, the damper is generally elongated in the direction of the disk centerline, i.e. the axial direction.

The seal 42 is a flexible element, typically made of thin sheet metal, adapted to reduce leakage. The seal is positioned radially inwardly of the damper, across the gap between the platform 28 and the adjacent blade platform (not shown), beneath and in proximity to the radially inner surfaces of the platforms. The shape of the seal generally conforms with that of the portion of the surface with which it is to seal. As illustrated, the damper 40 and seal 42 are radially supported by the pair of protrusions 64 on the blade 10 neck 65, however, any other suitable means known to those skilled in the art for holding the damper 40 and seal 42 in place may also be used. The damper 40 and seal 42 are described in further detail hereinbelow.

Referring now to FIG. 2, in a side view of the pressure side of the rotor blade 10, and damper 40 and seal 42 configuration, the radially inner surface 30 of the blade platform 28 has a damping portion 44, a transition portion 46 and a sealing portion 48. As shown, the damping portion 44 of the platform radially inner surface 30 has a substantially planar contour, however, the damping portion 44 may have any suitable contour known to those skilled in the art, including but not limited to a large radius, arcuate surface. The transition portion 46 of the platform radially inner surface 30 is located between the damping portion 44 and the sealing portion 48, where the radially inner surface 30 contour changes from that of the damping portion 44 to that of the sealing portion 48. Largely for this reason, no damping or sealing occurs in the transition portion 46. The transition portion 46 comprises upstream and downstream fillet runouts, shown as corners, having substantially arcuate contour, and providing a roughly ninety degree bend with a radius; however, the transition portion 46 may have any suitable contour known to those skilled in the art. The sealing portion 48 of the platform radially inner surface 30 is located where sealing against leakage is sought. The pressure on the radially outer surface 26 of the platform 28 is generally greater than that on the radially inner surface 30. For the blade 10, the magnitude of this pressure differential is comparatively high in the proximity of the platform supports. Consequently, as shown, the sealing portion 48 is located on the inside surfaces of the platform supports 36, 38; however, the sealing surface 48 may have any suitable location and contour known to those skilled in the art.

The damper 40 comprises a main body 50 and a pair of extended ends 52. The main body 50 has a damping surface 54 in contact with the damping portion 44 of the platform radially inner surface 30. The area of the damping surface 54 in combination with the weight of the damper 40, provide the friction force necessary to dampen vibration. The blade vibration comprises a broad spectrum of vibration frequency components. The frequency component at the natural resonant frequency of the blades has the greatest amplitude. In the best mode embodiment, the damper 40 is primarily effective for damping the first fundamental of the natural resonant frequency of the blades, however, any suitable damping characteristics may be used.

Generally, substantially uniform contact is sought between the surfaces 44, 54. To maintain such contact, the damper main body 50 and damping surface 54 should not extend into the transition portion 46 of the platform radially inner surface 30. This is primarily due to physical tolerances on the surfaces. Consequently, the dimensions of the damping surface 54 are substantially limited by features of the platform radially inner surface 30.

The extended ends 52 each have a proximal end, which transitions into the main body 50, and a distal free end, which is free. Clearances 55, between the extended ends 52 and the transition portion 46 of the radially inner surface 30 of the platform 28, obviate interference between those parts to allow uniform continuous contact between the damping surface 54 and the damping portion 44 of the platform radially inner surface 30. In the best mode embodiment, one of the extended ends 52 is upstream and the other is downstream, thereby extending the damper 40 in the axial direction, i.e. the direction from the platform leading edge 32 to the platform trailing edge 34. The extended ends 52 are preferably tapered to accommodate stress, gradually reducing in thickness from proximal end to distal end. This taper also allows the extended ends 52 to extend roughly half way through the transition portion 46, while still maintaining the clearances 55. In the best mode embodiment, the distal ends of the extended ends 52 are rounded. However, it will be apparent to those of ordinary skill in the art that the extended ends 52 may have any other orientation and shape which is suitably adapted to support the seal 42, avoid contact with the platform radially inner surface 30, and accommodate stress. Furthermore, although the extended ends 52 shown in the best mode embodiment appear similar, the extended ends need not have such similarity.

The damper 40 includes a radially inner support surface 56 which supports the seal 42. In the best mode embodiment, the support surface 56 extends the length of the damper 40, opposite the damping surface 54. As such, a significant portion of the support surface 56 is comprised of the extended ends 52, thereby allowing the support surface 56 to provide greater support for the seal than that provided by the main body 50 alone. The contour of the support surface 56 should be adapted to provide the desired support for the seal 42 in the particular application. In the best mode embodiment, the support surface 56 is substantially planar. However, it will be appreciated that, any other suitable shape, location, proportion and contour for the support surface 56 may also be used. The damper further comprises a pair of nubs 58 adapted to keep the damper 40 properly positioned with respect to the adjacent rotor blade (not shown).

The damper should comprise a material and should be manufactured by a method which is suitable for the high temperature, pressure and centrifugal force found within the turbine. In the best mode embodiment, a cobalt alloy material, American Metal Specification (AMS) 5382, and fabrication by casting, have been found suitable for high pressure turbine conditions; however any other suitable material and method of fabrication known to those skilled in the art may also be used.

The seal has a supported portion 60, in physical contact with the damper support surface 56, and a pair of sealing portions 62. The sealing portions 62 are adapted to provide seals against the sealing portion 48 of the platform radially inner surface 30. Each of the sealing portions has a proximal end, transitioning into the support portion 60 and a distal end, which is preferably free. The shapes of the supported and sealing portions 60, 62 closely conforms to that of the damper support surface 56 and sealing portion 48 of the platform radially inner surface 30, respectively. In the best mode embodiment, the supported portion 60 is substantially planar and the sealing portion 62 closely conforms to the inner surface of the platform supports 36, 38. An arcuate bend at the transition between the supported portion 60 and the sealing portion 62 is preferred.

The illustrated shape allows the seal 42 to receive radial support from the damper 40 and provide sealing against leakage. It should be noted that in the best mode embodiment, the sealing portions of the seal are forced into closer proximity with the sealing surfaces of the platform by centrifugal force. However, any other shape known to those of ordinary skill in the art which is suitably adapted to provide the desired sealing may also be used. Furthermore, although the sealing portions 62 shown in the best mode embodiment appear similar, the sealing portions need not have such similarity.

The seal should comprise a material and should be manufactured by a method which is suitable for the high temperature, pressure and centrifugal force found within the turbine. The seal 42 typically comprises a thin sheet of metal to allow the seal to flex to conform with the sealing portion 48 of the platform radially inner surface 30. In the best mode embodiment, the seal 42 comprises a cobalt alloy material, American Metal Specification (AMS) 5608, and is cut by laser, to a flat pattern. A punch and die is then used to form the rest of the seal 42 shape. However, any other suitable material and method of fabrication known to those skilled in the art may also be used.

FIGS. 3 and 4 illustrate further details of the damper 40. Referring now to FIGS. 3 and 4 in top view and side perspective views of the damper 40 in the best mode embodiment, the pair of nubs 58 are disposed on a concave side 68 of the damper 40. The damper 40 also comprises a convex side 69 which interfaces to the concave side 16 (FIG. 1) of the rotor blade 10. However, those of ordinary skill in the art should recognize that the damper 40 has a curved shape to accommodate blade 10 considerations which are not relevant to the present invention.

The incorporation of the extended ends 52 in the damper and seal configuration of the present invention provides greater support of the seal 42 to reduce undesirable seal deformation under centrifugal force loading conditions. This improves the effectiveness of the seal 42, thereby reducing gas leakage and improving the efficiency of the turbine.

The incorporation of the extended ends 52 can also improve damper performance. Since the weight of the damper 40 includes the weight of the main body 50 and the extended ends 52, the inclusion of extended ends 52 allows greater weight distribution flexibility, and a more uniform distribution of the damper friction force between two adjacent blades. For example, as will be commercially embodied, the weight of the damper of the best mode embodiment is substantially the same as that of prior art dampers. However, without the extended ends, the damper did not apply friction force of equal magnitude to the two adjacent blades. With the addition of the extended ends, there is more flexibility in the design of the damper to best provide the desired damping. The present damper is longer axially, narrower from side to side, and thicker from damping surface to support surface, than the previous damper. As a result, the friction force provided by the present damper is split more evenly between the two adjacent blades. In the best mode embodiment this provides improved vibration damping compared to that where the friction force is not uniformly distributed.

A second aspect of the damper and seal configuration of the present invention is illustrated in FIGS. 5, 6. Referring now to FIGS. 5, 6, in top and side views, respectively, of the seal 42 in the best mode embodiment, the seal 42 has a projection 70. The projection 70 is adapted to provide physical interference when the damper and seal are installed inverted in relation to each other, e.g. with seal 42 between damper 40 and platform radially inner surface 30, but not when the damper and seal are installed properly. Upon such improper installation, the interference does not allow the damper and seal to fit in the assembly. The projection 70 thus prevents such misassembly.

In the best mode embodiment, the projection is tab shaped, having a major surface 72 which extends from and is substantially perpendicular to the support portion 60. The direction in which the projection 70 extends from the support portion 60 is generally opposite to the direction of extended end of the sealing portions 62. When the seal is improperly installed between the damper and the platform radially inner surface 30 (FIGS. 1,2), the projection 70 creates an interference which does not allow both the damper and seal to fit between the platform radially inner surface 30 and the pair of protrusions 64 (FIG. 2), thus preventing misassembly. This improves effectiveness of the damper and seal and improves the reliability of the turbine.

The height of the projection 70 above the support surface 60 is less than the thickness of the damper 40. Consequently, when the damper and seal are installed in proper relation to each other, the projection 70 does not interfere with the contact between the damping surface 54 of the damper 40 and the damping portion 44 of the platform radially inner surface 30. However, it will be apparent to those of ordinary skill in the art, that the projection 70 may have any suitable shape which allows it to create an interference when the damper and seal configuration is not properly installed, including but not limited to a cylindrical shape. In the best mode embodiment, the projection 70 is integral to the support portion 60, being formed as part of the laser cut, punch and die process described above, and therefore does not significantly increase the cost of the seal 42; however, any other suitable method for forming and attaching the projection 70 to the seal 42 may be used.

Those of ordinary skill in the art should also recognize that the seal 42, like the damper 40, has a curved shape to accommodate blade 10 considerations which are not relevant to the present invention.

Figure 7:
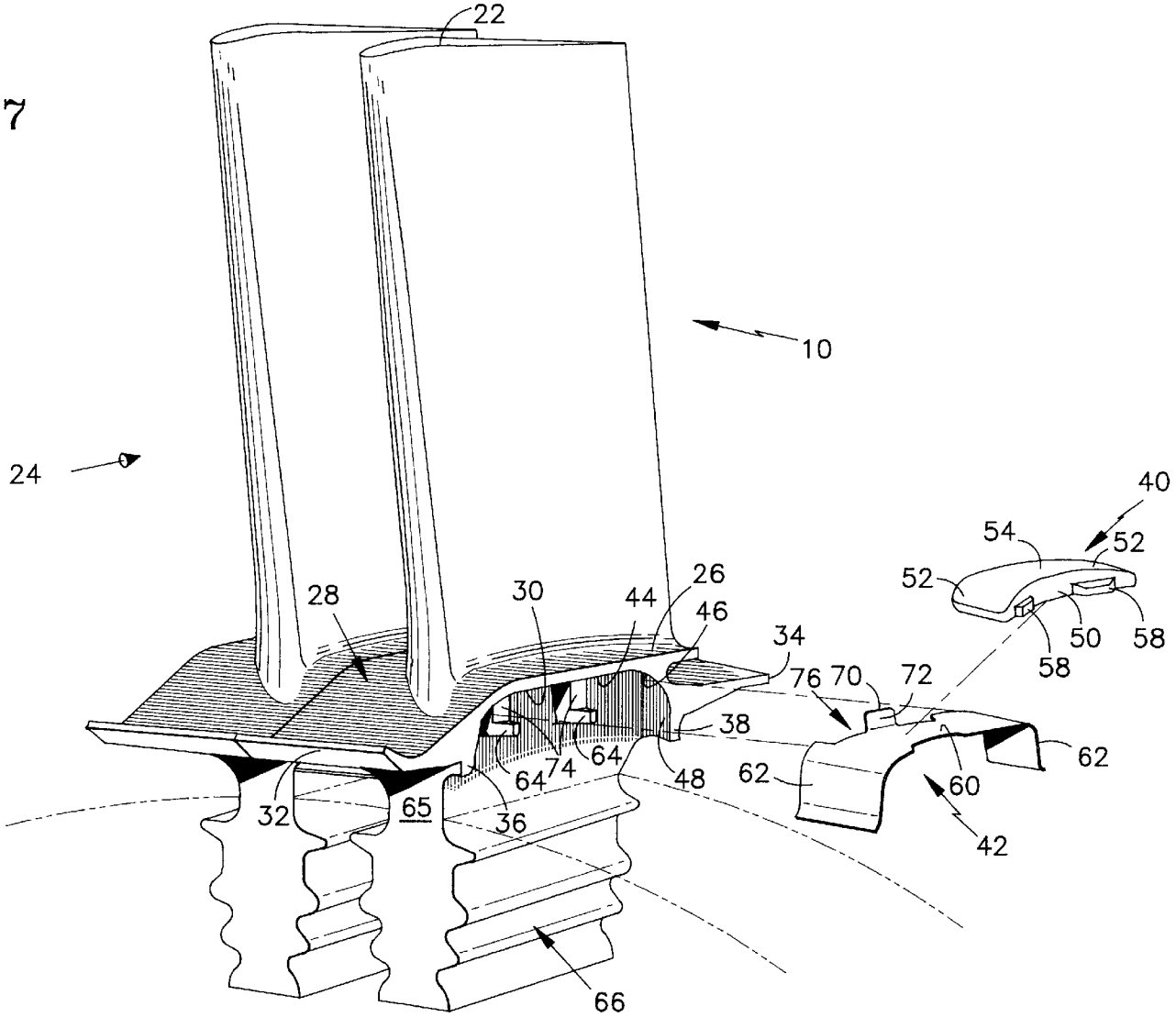
FIG. 7 is a perspective view of the rotor blade, damper, and seal of FIG. 1 shown separated prior to installation.

A third aspect of the present invention is illustrated in FIG. 7. Referring now to FIG. 7, in a perspective view of the best mode embodiment, prior to installation of the seal 42 into the blade 10, the blade 10 further comprises a pair of stand-offs 74. The pair of stand-offs 74 are adapted to help keep the damper 40 (FIGS. 1,2) and seal 42 in proper position with respect to the blade 10, i.e. the platform radially inner surface 30 and the neck 65. However, the stand-offs 74 do not retain the seal 42 in the proper axial position, i.e. from platform leading edge 32 to platform trailing edge 34. Consequently, a locator 76 in the support surface 60 has been added to the seal 42. When the seal 42 with the locator 76 is installed in the blade 10, the locator 76 interfaces with the stand-offs 74, and the combination holds the seal 42 in the desired axial position. In the best mode embodiment, the locator 76 is a notch, or scallop, which has a generally curving rectangular shape (FIG. 5) and spans both sides of the projection 70. This shape is adapted to properly interface with the stand-offs 74, which are located on the concave surface of the neck 65. It will be apparent that the locator 76 can be suitably adapted to operate with any stand-off configuration or other feature on the blade 10 which can provide a catch for the locator. It should also be obvious that instead of a notch, the locator 76 could be a tab that fits between the stand-offs 74. In the best mode embodiment, the locator 76 in the support surface 60 is formed as part of the laser cut, punch and die process described above, and therefore does not significantly increase the cost of the seal 42, however, any other suitable method for forming the locator 76 may be used.

The locator 76 in the seal 42 provides improved axial alignment of the seal 42 with the sealing portion 48 of the platform radially inner surface 30. Improved alignment results in improved seal effectiveness, reduced leakage and increased turbine efficiency.

Although the damper of the present invention is disclosed as having a pair of extended ends, it should be obvious to those of ordinary skill in the art that some applications may only require one such extended end while others may require more than two such extended ends. Similarly, although the seal of the present invention is disclosed as having sealing portions 62, it should be obvious to those of ordinary skill in the art that some applications may only require one and others may require more than two such sealing portions.

Those skilled in the art should also recognize that although best mode embodiment of the present invention is intended for use in a second stage high pressure turbine application, the present invention may be suitably adapted for other turbine applications, including but not limited to other high pressure turbine applications. Furthermore, although the damping system for low pressure turbine applications typically involves dampening with a tip shroud, it should be obvious to those of ordinary skill in the art that the present invention may also be suitably adapted for low pressure turbine applications.

Lastly, although the damper and seal are disclosed as a combination, it should be obvious that the damper may also be used without the seal and the seal may be used without the damper.

While the particular invention has been described with reference to first, second, and third aspects of a best mode embodiment, this description is not meant to be construed in a limiting sense. It is understood that various modifications of the best mode embodiment, as well as additional embodiments of the invention, will be apparent to persons skilled in the art upon reference to this description, without departing from the spirit of the invention, as recited in the claims appended hereto. It is therefore contemplated that the appended claims will cover any such modifications or embodiments as fall within the true scope of the invention.

What is claimed is:

1. A rigid vibration damper for use with two adjacent turbine rotor blades in a gas turbine engine, each turbine rotor blade having an airfoil portion, a platform, a neck, and a root, the blade platforms each having a radially outer surface, and a radially inner surface connected by the blade neck to the blade root, the radially inner surface having a damping portion a sealing portion radially inward of the damping portion, and a transition portion disposed between the damping and the sealing portions, the rigid damper comprising:

a main body having a damping surface adapted to contact the damping portion of the radially inner surface of each blade platform and to provide a friction force on the damping portions; and at least one end axially extended from said main body, and adapted to clear the transition and the sealing portions of the radially inner surfaces of each blade platform.

2. The damper of claim 1 wherein said at least one end is free.

3. The damper of claim 1 wherein said damping surface of said main body is substantially planar.

4. The damper of claim 1 wherein each of said at least one end has an axial length that is less than or equal to about one half that of the main body.

5. The damper of claim 1 wherein the sealing portion comprises a radially inward skirt.

6. The damper of claim 1 wherein the transition portion of the radially inner surfaces has an arcuate contour and each of said at least one extended end is tapered, gradually reducing in thickness.

7. The damper of claim 6 wherein the transition portion of the radially inner surfaces provides a roughly ninety degree bend.

8. The damper of claim 1 wherein said damping surface of said main body is substantially planar and each of said at least one end is free is tapered and gradually reducing in thickness, and has axial length that is about one half that of the main body, and wherein the sealing portion of the radially inner surfaces comprises a radially inward skirt and the transition portion of the radially inner surfaces has an arcuate contour.

9. The damper of claim 8 wherein the transition portion of the radially inner surfaces provides a roughly ninety degree bend.

10. A damping and sealing apparatus for use with two adjacent turbine blades, each blade having an airfoil, a platform a neck, and a root, the blade platforms each having a radially outer surface supporting the airfoil, and a radially inner surface connected by the blade neck to the blade root, the radially inner surface having a damping portion, a sealing portion, and a transition portion located between the damping and the sealing portions, the apparatus comprising:

a flexible seal, having at least one sealing portion extending from a supported portion, said at least one sealing portion adapted to provide sealing in combination with the sealing portion of the adjacent blade platform radially inner surfaces; and a rigid damper, having at least one end extending from a main body, said at least one extended end and said main body disposed between the adjacent blade platform radially inner surfaces and said supported portion of said seal, said main body having a damping surface in contact with the damping portion of the radially inner surfaces and adapted to provide a friction force on the damping portions, said at least one extended end being of a length sufficient to clear the adjacent platform radially inner surfaces, and said main body and said at least one extended end each having a support surface in contact with said supported portion of said seal and adapted to provide support therefor.

11. The apparatus of claim 10 wherein said at least one extended end extends said damper in an axial direction.

12. The apparatus of claim 11 wherein said damping surface of said main body is substantially planar and each of said at least one end is free is tapered and gradually reducing in thickness, and has an axial length that is about one half that of the main body, and wherein the sealing portion of the radially inner surfaces comprises a radially inward skirt and the transition portion of the radially inner surfaces has an arcuate contour.

13. The apparatus of claim 12 wherein the transition portion of the radially inner surfaces provides a roughly ninety degree bend.

14. The apparatus of claim 10 wherein said at least one extended end is tapered.

15. The apparatus of claim 10 wherein the transition portion includes upstream and downstream fillet runouts and said at least one extended end comprises a pair of tapered ends which extends said damper in an axial direction from the upstream fillet runout to the downstream fillet runout.

16. The apparatus of claim 10 wherein said support surface of said damper has a substantially planar surface.

17. The apparatus of claim 10 wherein said damping and said support surfaces of said damper have substantially planar surfaces, and said support surface is generally opposed to said damping surface.

18. The apparatus of claim 10 wherein said supported portion of said flexible seal further comprises a locator which interfaces with one of the blades when the flexible seal is installed, to positively position and maintain the flexible seal axially relative to the blade.

19. The apparatus of claim 18 wherein said flexible seal further comprises a projection extending from said supported portion which provides an interference when the flexible seal and the damper are installed in improper relation to each other.

20. The apparatus of claim 8 wherein said at least one extended end extends said damper in an axial direction.

21. The apparatus of claim 20 wherein said at least one end is free.

22. The apparatus of claim 20 wherein said damping surface of said main body is substantially planar.

23. The apparatus of claim 20 wherein each of said at least one end has an axial length that is about one half that of the main body.

24. The apparatus of claim 20 wherein the transition portion of the radially inner surfaces has an arcuate contour and each of said at least one end is tapered, gradually reducing in thickness.

25. The apparatus of claim 24 wherein the transition-portion of the radially inner surfaces provides a roughly ninety degree bend.

26. The apparatus of claim 18 wherein the transition portion includes forward and rear fillet runouts and said at least one extended end comprises a pair of extended ends which extends said damper in an axial direction from the forward fillet runout to the rear fillet runout.

27. The apparatus of claim 16 wherein said support surface of said damper has a substantially planar surface opposed said damping surface of said damper.

28. The apparatus of claim 27 wherein said at least one sealing portion of said flexible seal comprises a pair of sealing portions and said supported portion of said flexible seal is substantially planar, said seal having an arcuate bend disposed between said supported portion and each of said sealing portions.

29. The apparatus of claim 18 wherein one of the blades has a catch on its neck for said interface between said locator and the blade.

30. The apparatus of claim 29 wherein the catch comprises a pair of standoffs and the locator comprises a notch.

31. The apparatus of claim 30 wherein said flexible seal further comprises a tab projecting from said supported portion which provides an interference with one of the blades when the flexible seal and the damper are installed in improper relation to each other.

32. The apparatus of claim 31 wherein said damping surface of said main body is substantially planar and each of said at least one end is free, extends said damper in an axial direction, is tapered and gradually reducing in thickness, and has an axial length that is about one half that of the main body, and wherein the sealing portion of the radially inner surfaces comprises a radially inward skirt and the transition portion of the radially inner surfaces has an arcuate contour.

33. The apparatus of claim 32 wherein the transition portion of the radially inner surfaces provides a roughly ninety degree bend.

34. The apparatus of claim 10 wherein said supported portion of said flexible seal further comprises a notch which interfaces with one of the blades when the flexible seal is installed, to positively position and maintain the flexible seal axially relative to the blade.

35. The apparatus of claim 34 wherein said flexible seal further comprises a tab projecting from said supported portion which provides an interference with one of the blades when the flexible seal and the damper are installed in improper relation to each other.

36. The apparatus of claim 10 wherein said flexible seal further comprises a projection extending from said supported portion which provides an interference when the flexible seal and the damper are installed in improper relation to each other.

37. The apparatus of claim 10 wherein said flexible seal further comprises a tab projecting from said supported portion which provides an interference with one of the blades when the flexible seal and the damper are installed in improper relation to each other.

38. The apparatus of claim 10 wherein said at least one sealing portion of said flexible seal comprises a pair of sealing portions and said supported portion of said flexible seal is substantially planar, said seal having an arcuate bend disposed between said supported portion and each of said sealing portions.

39. The apparatus of claim 10 wherein said at least one end is free.

40. The apparatus of claim 10 wherein said damping surface of said main body is substantially planar.

41. The apparatus of claim 10 wherein each of said at least one extended end has an axial length that is about one half that of the main body.

42. The apparatus of claim 10 wherein the transition portion of the radially inner surfaces has an arcuate contour and each of said at least one end is tapered and gradually reducing in thickness.

43. The apparatus of claim 42 wherein the transition portion of the radially inner surfaces provides a roughly ninety degree bend.

44. An apparatus for two adjacent turbine blades in a gas turbine engine, each blade having an airfoil, a platform, a neck, and a root, the blade platforms each having a radially outer surface supporting the airfoil, and a radially inner surface connected by the blade neck to the blade root, the radially inner surface itself having a damping portion, a sealing portion, and a transition portion located between the damping and sealing portions, the damping portion generally facing the disk, the apparatus comprising:

a flexible seal, having at least one sealing portion joined to a supported portion, said at least one sealing portion adapted to provide sealing in combination with the sealing portion of the adjacent blade platform radially inner surfaces, said seal further having a projection joined to said supported portion;

a rigid damper, disposed between the adjacent blade platform radially inner surfaces and said supported portion of said seal, said damper having a damping surface in contact with the damping portion of the radially inner surfaces and adapted to provide a friction force on the damping portions, said damper having a support surface in contact with said supported portion of said seal and adapted to provide support for the seal, and said projection of said seal providing an interference with one of the blades when said damper and said seal are installed in improper relation to each other.

45. A flexible seal for use with two adjacent turbine rotor blades in a gas turbine engine, each blade having an airfoil, a platform a neck, and a root the blade platforms each hawk a radially outer surface supporting the airfoil and a radially inner surface connected by the blade neck to the blade root, the radially inner surface itself having a sealing portion one of the blades having a catch on its neck, the flexible seal comprising:

a supported portion adapted to receive radial support for the seal, said supported portion having a locator which interfaces with the catch when the flexible seal is installed in the adjacent blades to positively position and maintain the flexible seal in an axial position with respect to the radially inner surfaces of the blade platforms: and at least one sealing portion joined to said, supported portion and adapted to provide sealing in combination with the sealing portion of the adjacent blade platform radially inner surfaces;

wherein the catch includes a standoff.

46. The flexible seal of claim 45 wherein said locator comprises a notched edge.

47. The flexible seal of claim 45 wherein said locator comprises a notch and the catch includes a pair of standoffs adapted to position the seal in a circumferential direction relative to the neck.

48. The flexible seal of claim 47 wherein the neck has a concave surface on which said standoffs are located and said notch has a generally curving rectangular-like shape.

49. A flexible seal for use with two adjacent turbine rotor blades and a rigid damper in a gas turbine engine each blade having an airfoil, a platform, a neck, and a root the blade platforms each having a radially outer surface supporting the airfoil, and a radially inner surface connected by the blade neck to the blade root the radially inner surface itself having a damping portion and a sealing portion, the damper having a damping surface and a support surface, the damping surface being adapted to contact with and provide a friction force on the damping portion of the radially inner surface of each blade platform, one of the blades having a catch on its neck the flexible seal comprising:

a supported portion adapted to receive radial support from the support surface of the damper, said supported portion having a locator which interfaces with the catch when the flexible seal is installed in the adjacent blades, to positively position and maintain the flexible seal in an axial position with respect to the radially inner surfaces of the blade platforms, and at least one sealing portion joined to said supported portion and adapted to provide sealing in combination with the sealing portion of the adjacent blade platform radially inner surfaces.

50. The flexible seal of claim 49 wherein said locator comprises a notch.

51. The flexible seal of claim 49 wherein the catch includes a standoff.

52. The flexible seal of claim 49 wherein said locator comprises a notch and the catch includes a pair of standoffs adapted to position the seal in a circumferential direction relative to the neck.

53. The flexible seal of claim 52 wherein the neck has a concave surface on which the standoffs are located and said notch has a generally curving rectangular-like shape.

* * * * *